United States Patent [19]

Huber

[11] 4,375,487

[45] Mar. 1, 1983

[54] INSTALLATION FOR POWDER-COATING WORK PIECES

[75] Inventor: Willy Huber, Altstatten, Switzerland

[73] Assignee: J. Wagner AG, Switzerland

[21] Appl. No.: 249,652

[22] Filed: Mar. 31, 1981

[30] Foreign Application Priority Data

Apr. 2, 1980 [DE] Fed. Rep. of Germany ..... 3012877

[51] Int. Cl.[3] ..... B05D 1/06; B05B 7/00

[52] U.S. Cl. ..... 427/195; 427/421; 427/185; 98/115 SB; 118/309; 118/312; 118/326; 118/DIG. 7

[58] Field of Search ..... 98/115 SB; 55/302; 427/195, 185, 421; 118/309, 326, 312, DIG. 7, 308

[56] References Cited

U.S. PATENT DOCUMENTS

| | | | |
|---|---|---|---|
| 2,907,299 | 10/1959 | Weiner | 118/309 |
| 3,100,724 | 8/1963 | Rocheville | 118/312 X |
| 3,503,778 | 3/1970 | Corbett et al. | 427/195 |
| 3,687,702 | 8/1972 | Le May | 118/309 X |
| 3,724,416 | 4/1973 | Diamond et al. | 118/312 X |
| 3,801,869 | 4/1974 | Masuda | 98/115 SB X |
| 4,277,260 | 7/1981 | Browning | 118/326 X |
| 4,297,386 | 10/1981 | Gillette | 427/185 X |
| 4,303,417 | 12/1981 | Koch | 118/326 X |

*Primary Examiner*—Shrive P. Beck

*Attorney, Agent, or Firm*—Hill, Van Santen, Steadman, Chiara & Simpson

[57] ABSTRACT

A powder spray chamber balances the downward forces of gravity on the coating particles with upward exhaust forces to suspend the coating materials adjacent the work piece for a longer period of time than would otherwise be possible.

8 Claims, 3 Drawing Figures

INSTALLATION FOR POWDER-COATING WORK PIECES

BACKGROUND OF THE INVENTION

1. Field of the Invention

The invention relates to an installation for powder-coating work pieces with a spray chamber which temporarily accepts the object to be coated. The installation includes at least one spray device for delivering powdery coating material to the object to be coated within said spray chamber and a suction line connected to a blower or fan to exhaust the chamber. The invention likewise relates to a method for powder-coating in such a spray chamber.

2. The Prior Art

Powder coating installations are known from German AS No. 24 30 517. In the German '517 patent document, as in all other comparable embodiments which are known, an evacuation of excess coating material takes place at the floor of the spraying chamber. Thus, the underpressure in the spray chamber due to the exhaust system as well as gravity, influence the coating material sprayed in in the form of a cloud. As a result, the individual particles of the coating material quickly sink down and, thus, sufficient precipitation onto the work piece and a satisfactory coating do not result. Above all, however, what is disadvantageous is that a great deal of unused coating material results. This unused material must be carried off and re-processed by means of filters and other devices. The additional equipment required for this purpose must, therefore, be dimensioned correspondingly large. Further, due to the large quantity of material to be filtered, the filters must be cleaned or replaced after a short time. Thus, interruptions in operation can only be avoided with a high degree of expense and equipment. Since the evacuation openings are located at the floor, the cleaning of such a chamber, given a change of color or powder, also results in a considerable outlay involving time and work.

SUMMARY OF THE INVENTION

In the inventive installation for powder-coating work pieces, a high degree of precipitation of the coating material sprayed into the chamber onto the work piece results. Thus, an extraordinarily good coating can be achieved. Additionally, only a very small amount of unused coating material occurs, since there is a high degree of precipitation. Moreover, the cleansing of the spray chamber and, thus, a change of color can be accomplished in a very short time and without problems.

The inventive installation includes a spray chamber with one or more evacuation openings which are provided in a ceiling of the spray chamber and/or in its lateral walls in the area above the work piece to be coated. As a result, one or more evacuation chambers or channels passing through the spray chamber are formed above the work piece. These evacuation chambers or channels are connected to an exhaust system.

An evacuation of the excess coating material within the inventive installation thus occurs vertically above the work piece to be coated. It is appropriate to select the underpressure which can be generated by means of the exhaust system in the area of the work piece to be coated in such a manner that a state of equilibrium exists between the upward forces influencing the particles of the coating material which result from the underpressure and the downward force of gravity such that the particles are nearly kept in a state of suspension.

As a result of using the inventive installation, the coating material sprayed is not immediately evacuated. Rather, it is suspended for a period of time in the spray chamber and can settle on the work piece to be coated during that time. The amounts of precipitation of the applied material onto the work piece are, thus, extremely large. As a result, excellent coatings can be achieved. Since nearly all of the material sprayed in the chamber is deposited onto the workpiece, only a slight amount of excess coating material need be carried off and re-processed. The cleansing of the spray chamber given a change of color or powder is likewise very simple and can be undertaken in a short time, since no special covers are required and the chamber can therefore be easily swept out.

It is further expedient given the inventively designed installation to position replaceable filters in front of or in the evacuation openings, the evacuation chambers or in the suction lines. The filters can be designed as flat filters preferably extending over the length of the spray chamber which can be interchangeably inserted in said spray chamber or in the evacuation openings. Alternately, replaceable filtering tubes which entirely or partially pass through the spray chamber above the work piece to be coated and which can be connected to the suction line can be used.

Since the filters are only charged with a slight amount of excess coating material, their contamination is slight, so that cleansing is only seldom required. Accordingly, a high service life results.

It is further appropriate to provide an exhaust system with a reversible direction of flow in order to generate a reverse air flow through the filters. By so doing, the material adhering to any given filter can be quickly blown off in case of a change of color and be removed together with the material deposited in the spray chamber.

In order to exclude the possibility of particles which may be suspended at or in the filters from falling onto the work piece during a coating operation, it is advantageous according to a further development to dispose one or more coverings in the form of an intermediate ceiling in the spray chamber above said work piece. These coverings form discharge channels together with the side walls of the spray chamber.

It is also expedient to design the coverings so that they slope, in the manner of a roof or funnel, toward the side walls of the spray chamber, to provide each of them with an essentially vertical end plate at those ends facing the side walls of the spray chamber, and to attach them within the spray chamber so as to be adjustable in height.

In order to be able to discharge the excess coating material in a simple manner, the floor of the spray chamber should be sloped in the manner of a funnel or roof and be connected to the source of coating material. Additionally, a sieve or filter preferably designed as a riddle sifter or drum sieve can be provided in the floor.

The inventive method comprises the steps of:

supporting the workpiece within the spray chamber;

spraying the coating material toward the work piece;

suspending the coating material adjacent the work piece for a period of time in order that it will deposit on the workpiece;

exhausting a portion of the unused material; and collecting most of the rest of the material on the floor of the spray chamber.

DECRIPTION OF THE PREFERRED EMBODIMENTS

Figure 1:
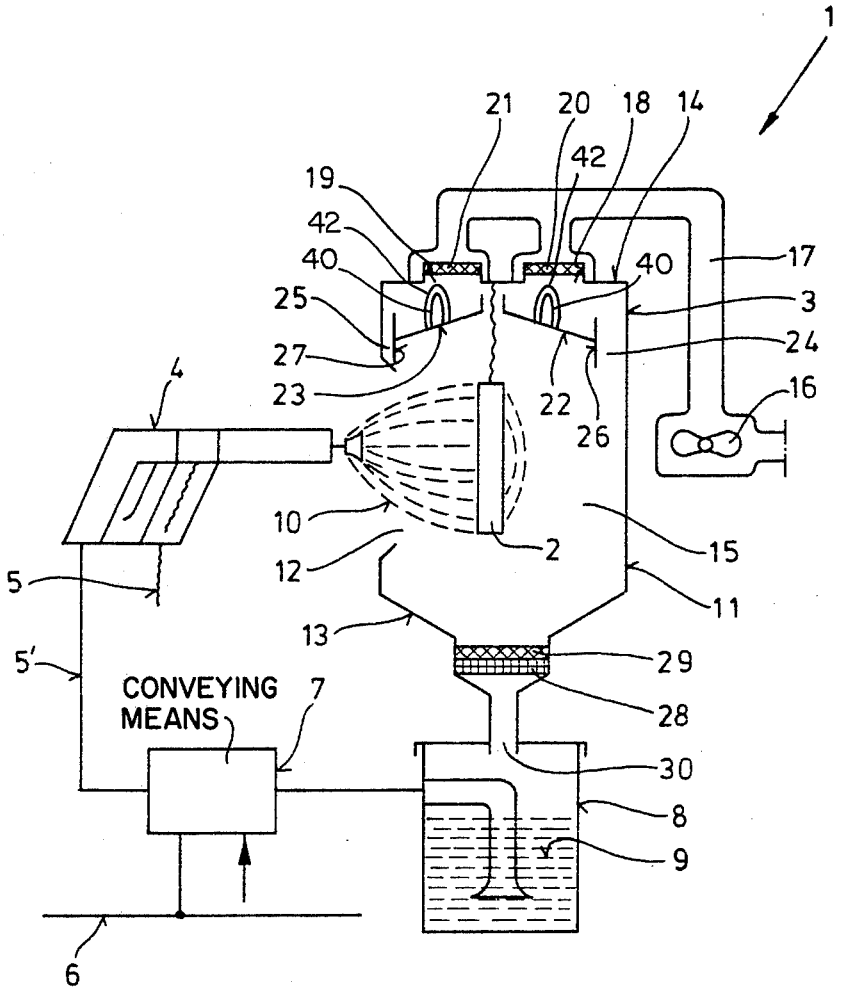
FIG. 1 is a longitudinal schematic section of a powder coating installation incorporating a spray chamber according to the present invention.
Figure 2:
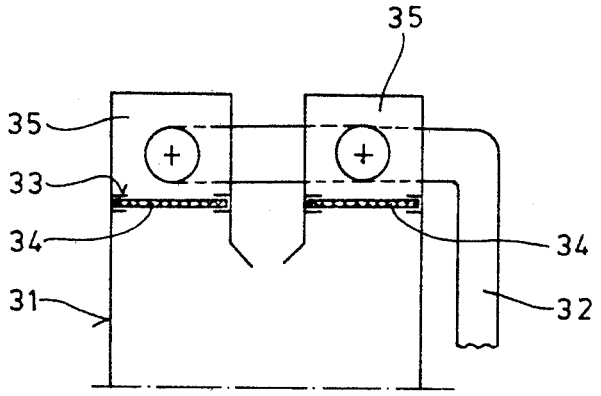
FIG. 2 is a schematic sectional view of one filter arrangement.
Figure 3:
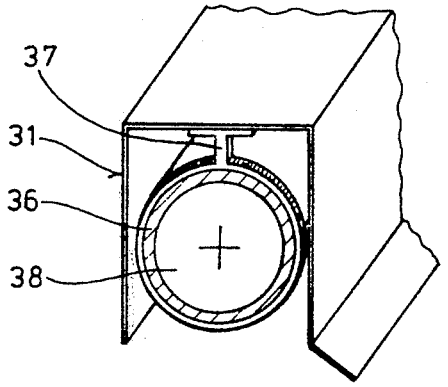
FIG. 3 is an enlarged partial view in perspective of an alternate filter arrangement.

Not by way of limitation, but by way of disclosing the best mode of practicing my invention, and by way of enabling one of ordinary skill to practice my invention, there are disclosed in FIGS. 1 through 3 two forms of my invention.

An electrostatic spray installation 1 is shown schematically in FIG. 1. Installation 1 includes a spray chamber 3 which temporarily accepts a work piece 2 to be coated. A spray device 4 for delivering a powdery coating material 10 is shown directing a flow of powdered material 10 toward work piece 2. The spray device 4 is connected to the power mains via a line 5 and is connected via a further line 5' to a feeder container 8 in which the material 9 to be sprayed is stored. A conveying means 7 which is connected to a compressed air line 6 is inserted in the line 5' and provides powdered material to the gun 4.

The spray chamber 3 has side walls 11. One of the side walls 11 is provided with an opening 12 in order to be able to introduce the spraying device 4 into an inside space or region 15 of the spray chamber 3. The spray chamber 3 also has a floor 13, as well as of a ceiling 14. An exhaust fan or blower 16 to which a suction line 17 is connected, serves for the evacuation of the excess coating material.

Evacuation openings 18 and 19 of the suction line 17 open into the spray chamber 3 in the ceiling 14. The excess coating material is suctioned off toward the top of the chamber 3. The underpressure generated by the exhaust system thus opposes the force of gravity, and must be selected in such a manner that the forces influencing the particles of the coating material 10 and consisting of underpressure and the force of gravity are approximately in equilibrium in the area of the work piece 2. The coating material 10 is sprayed in the form of a cloud. As a result, it is kept in suspension during a longer time and can precipitate onto the work piece 2 during said time span. By so doing, an extremely good coating with a high degree of precipitation results. The part of the material not adhering to the work piece 2 falls to the floor 13. As a result, only a very slight amount of excess coating material need be carried off by means of the exhaust fan or blower 16. The actual air flow through the booth necessary to maintain particulate suspension will differ for each type of installation depending on back size, shape, number of evacuation openings and type of powder used. In general, it is desired to provide an up air flow adjacent the coating area around the material to be coated which approximates the fall rate of the powder particles.

Flat filters 20 and 21 are inserted in the evacuation openings 18 and 19 so that no coating material can pass into the suction line 17. In order to cleanse said filters given a change of color, it is only necessary to briefly reverse the direction of flow of the exhaust air from the exhaust fan or blower 16 so that the filters 20 and 21 are blown out with a reverse air flow. The powder particles adhering to said filters are then repelled into region 15.

In order to be able to protect the work piece 2 during the coating operation from powder particles which may fall off from the filters 20 and 21, coverings 22 and 23 in the form of an intermediate ceiling are attached in the inside space 15 of the spray chamber 3 above the work piece 2. The coverings 22 and 23 are adjustable in height so that work pieces of different size can also be coated. The coverings 22, 23 are roof-shaped and are each provided with a vertical edge member 26 or 27 at their ends facing the side walls 11. Channels 24 and 25 are thus formed through which the air is suctioned off from the inside space 15 of the spray chamber 3 by means of the exhaust fan or blower 16.

The floor 13 of the spray chamber 3 is designed funnel-shaped so that descending coating material collects by itself and can be supplied via a line 30 to the feeder container 8. A riddle sifter 28 provided with a filter 29 is also built into the floor 13.

In the spray chamber 31 which is only partially illustrated in FIG. 2, two underpressure chambers 35 are provided. The chambers 35 are at the top of the spray chamber 31 and are each connected to a suction line 32. The underpressure chambers 35 are formed by means of replaceable flat filters 34 which are held in guides 33. The filters 34 can be easily removed in order to clean the spray chamber 31. The suction line 32 can be covered by dummy plates inserted in the guides 32 for cleaning purposes.

According to FIG. 3, a filter 36 in the form of a filtering tube is inserted in the upper range of the spray chamber 31. The filter 36 is secured to the ceiling of the spray chamber 31 by means of a bracket 37. The filter 36 is likewise connected at its end face to the suction line (not illustrated), so that its inside space forms a suction channel 38. In this embodiment, the surface of the filter 36 is particularly great, so that a long service life results. Only a slight suction velocity is required with the filter 36. Given a change of color, the filter 36 can likewise be removed from the spray chamber 31 in a short time.

With respect to FIG. 1, deflection members 22, 23 can be adjusted by releasing threaded members, screws or bolts 40 and adjusting slotted members 42, affixed to members 22, 23, vertically with respect to threaded members 40. Members 40 can be retightened into the side wall 11 thereby supporting deflection plates or members 22, 23 at a new height.

While various modifications and suggestions might be proposed by those skilled in the art, it will be understood that I wish to include all such modifications and changes within the claims of the patent warranted hereon as reasonably come within my contribution to the art.

I claim as my invention:

1. An improved installation for powder-coating a work piece, including an enclosed spray chamber adapted to temporarily receive the work piece to be coated, at least one spray device for delivering powdery coating material to the work piece and an exhaust line connected between an exhaust system including an exhaust means and the spray chamber, said improvement comprising at least one evacuation opening provided in an upper area of the spray chamber in a region above the work piece to be coated, at least one evacuation channel means formed in the chamber above the work piece, said evacuation channel means connected to the exhaust line through the opening, replaceable filter means positioned between the spray chamber and said evacuation openings, deflection means in the form of an intermediate ceiling positioned in the spray chamber above the work piece to be coated and below said replaceable filter means and adapted to keep excess coating powder from falling from the top of the spray chamber or said filter means onto the work piece, said deflection means together with the side walls of the spray chamber form said exhaust channels through which powder and gas to be exhausted flow in response to forces generated by said exhaust means, said deflection means being planar and sloping towards the sidewalls of the spray chamber, and further vertical planar members affixed to end regions of said planar deflection means adjacent to and spaced apart from the sidewalls of the spray chamber.

2. In a method for coating a work piece suspended in a chamber which is in turn connected to an exhaust system having the step of spraying a cloud of coating material toward the work piece, improvement steps comprising:

generating upwardly oriented forces by using the exhaust system to partly evacuate an upper end of the chamber;

balancing the downwardly oriented force of gravity exerted on each particle of coating material by means of the upwardly oriented forces such that each particle of coating material in the cloud is suspended for a selected period of time in the vicinity of the work piece;

depositing a coating of material from the cloud onto the work piece;

removing a portion of the residual non-deposited coating material from the top of the chamber through the exhaust system;

removing any remaining suspended and non-deposited non-coating material through the floor of the chamber so that it may be recirculated and used again;

filtering the portion of residual non-deposited coating material being removed from the chamber through the exhaust system as that portion is leaving the chamber; and deflecting residual non-deposited coating material being removed from the chamber by said exhaust system from falling onto the work piece.

3. The method according to claim 2, including a further step of:

collecting the remaining non-suspended and non-deposited coating material in a centrally located material supply chamber positioned below the floor.

4. The method according to claim 3, including a further step of:

filtering the collected material before depositing it into the material supply chamber.

5. In a spray chamber for applying a coating of material to a work piece, the spray chamber essentially encloses a region wherein the work piece is suspended and has a ceiling and a floor, an exhaust system is connectable to the chamber, an improvement comprising:

at least a first chamber formed in the ceiling and connectable to the exhaust system;

replaceable means for filtering positioned in said first chamber formed in the ceiling;

means for deflection positioned between said means for filtering and the work piece;

and wherein said floor slopes downwardly to form a centralized material removal opening;

said means for deflection comprises at least one planar member positioned between the work piece and said replaceable flat filter, said planar member is adapted to deflect any particles of material that fall from said filter toward the work piece; and an essentially vertical planar member affixed to an end of said planar deflection member adjacent a sidewall of the spray chamber.

6. The apparatus according to claim 5 including means for vertically adjusting said one planar member.

7. The apparatus according to claim 5 wherein said centralized material removal opening includes filter means.

8. The apparatus according to claim 5, wherein said exhaust system is adapted to generate upwardly oriented forces by creating a partial vacuum in said first chamber, said upwardly oriented forces are adapted to balance downwardly oriented forces of gravity on each particle of material in the vicinity of the work piece thereby suspending each such particle for selected periods of time to increase the quantity of such particles which are deposited on the work piece.

* * * * *